US005443265A

United States Patent [19]

Wheeler

[11] Patent Number: 5,443,265

[45] Date of Patent: Aug. 22, 1995

[54] GOLFING STROKE TRAINER

[76] Inventor: Charles H. Wheeler, 5618 Lynwood Pl., Boise, Id. 83704

[21] Appl. No.: 242,183

[22] Filed: May 13, 1994

[51] Int. Cl.[6] ..... A63B 69/36

[52] U.S. Cl. ..... 273/186.2; 273/192

[58] Field of Search ..... 273/186.1, 192, 186.2, 273/187.1

[56] References Cited

U.S. PATENT DOCUMENTS 3,471,155 10/1969 Donaldson ..... 273/192 X
5,294,124 3/1994 Florian ..... 273/186.1
5,332,211 7/1994 Rife et al. ..... 273/192 X

*Primary Examiner*—George J. Marlo
*Attorney, Agent, or Firm*—Stan Protigal; Michael Starkweather

[57] ABSTRACT

A golfing stroke trainer mat is provided with both back stroke and follow-through markings. Specifically, there are perpendicular and longitudinal lines running the length of the mat that aid in club head alignment and path. Measurement numbers to provide feedback on the length of both the back and follow through strokes. Uniquely, the invention can have colored matching sections to aid in the matching of the length of the strokes with or with out the numbering. The mat can be designed with colored lines, and/or lines having varying widths. Both of these schemes are designed to aid the golfer in controlling a pendulum stroke with equal back and follow through strokes. Another feature of the invention is that the golf clubs are marked with both a longitudinal and lateral line to match the lines on the golf mat. The mat is designed with a V shaped notch beginning at the center of the rectangular mat and extending to one of the longer ends. This notch will not interfere with the ball roll on long putts, and yet provides an alignment reference on the "follow through" portion of the golf stroke after the ball is hit and aids in aligning the ball accurately into a center position.

16 Claims, 1 Drawing Sheet

GOLFING STROKE TRAINER

FIELD OF THE INVENTION

The present invention relates generally to practice of golf strokes for putters and other clubs. More particularly there is a mat having markings to aid in both back and follow through strokes.

BACKGROUND OF THE INVENTION

As in many other sports such as, for example, tennis, the performance of a player depends on the accuracy with which they are able to control their muscles and on the degree of perfection with which the playing operations are carried out. This holds true particularly for golfing, where a player's performance depends essentially on the degree of perfection with which they have learned the correct positions and movements of each single muscle of the body required for hitting the ball. The player wants to instinctively assume the correct position and make the correct movements.

Particularly, in golf, it is important to control the back stroke and the follow through of the stroke in order to achieve the maximum control of the stroke and ultimately the correct hitting of the ball.

Problems

A major problem has long existed from prior art golf stroke mats. In particular, they typically only aid in the back stroke of the golf clubs. For example, U.S. Pat. No. 2,992,005, illustrates markings on a mat to aid in the back stroke and only a very short distance after the location of the ball is marked. It is obvious that there is little feedback provided to the golfer wanting feedback on the complete stroke.

It is often the case that golfers that have been trained by use of such devices will learn good back stroke control. However, the shots of these players do not necessarily go where they want them. Upon close examination of their strokes, it is the follow through stroke that is going wrong. When the follow through stroke is off, control of the shot is diminished and the ball may miss the target.

It is noted that the above described problems, as well as other problems, are solved through the subject invention and will become more apparent, to one skilled in the art, from the detailed description of the subject invention.

SUMMARY OF THE INVENTION

One skilled in the art will appreciate the advantage of the subject golfing stroke trainer having a mat with both back stroke and follow-through markings. These markings provide feedback on both the basic stroke and follow through. Specifically, there are longitudinal and lateral horizontal lines running the length of the mat, corresponding to putthead angle and stroke path, respectively. Also, there are measurement numbers to provide feedback on the length of both the back and follow through strokes.

Uniquely, the invention can have colored matching sections to aid in the matching of the length of the strokes with or with out the numbering. Additionally, the invention can be designed with colored lines, and/or lines having varying widths. Both of these schemes are designed to aid the golfer in controlling a pendulum stroke with equal back and follow through strokes.

Another feature of the invention, is that the putters or other golf clubs are marked with both a longitudinal and a lateral line to match the lines on the golf mat, providing the feedback necessary to keep the putter square to and along the target line.

Still another feature of the invention is that the mat is designed with a V shaped notch beginning at the center of the rectangular mat and extending to one of the longer ends, and therefore forming two identical arms on either side of the notch. This notch has the advantage that the mat can extend forward of the ball and yet will not interfere with the ball roll on putts. The V shaped notch further allows for putts to be off center and yet provide feedback to the golfer. The notch further facilitates alignment of the ball with the markings on the mat and avoids interference with the ball.

Other features and objects of the present invention will become more clear from the following detailed description of the invention, taken in conjunction with the accompanying drawings and claims, or may be learned by the practice of the invention.

Figure 1:
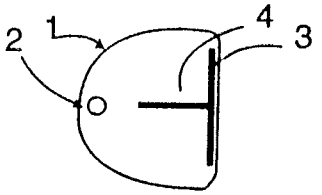
FIG. 1 is a detailed illustration of a golf club head.

It is noted that the drawings of the invention are not to scale. The drawings are merely schematic representations, not intended to portray specific parameters of the invention. The drawings are intended to depict only typical embodiments of the invention, and are therefore not to be considered limiting of its scope.

The invention will be described with additional specificity and detail through the use of the accompanying drawings. Additionally, like numbering in the drawings represent like elements within and between drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8 of the U.S. Constitution).

Incorporated Material

The following U.S. patents are herein incorporated by reference for pertinent and supporting information:

U.S. Pat. No. 2,750,195, is a putter guide.

U.S. Pat. No. 2,941,808, is a golf practice mat.

U.S. Pat. No. 2,992,005, is a putting guide.

U.S. Pat. No. 3,332,688, is a golf putting aid.

U.S. Pat. No. 4,113,258, is a golfer's club stroke and stance training device.

U.S. Pat. No. 5,035,433, is a golf stroke training mat.

General Embodiment

FIG. 1 is a detailed illustration of a golf club modified for use with the mat and includes the following elements: The club 1 has a shaft 2 with a lateral line 3 and longitudinal line 4. It is possible to incorporate more than one lateral line and more than one longitudinal line to accommodate variations in alignment.

Figure 2:
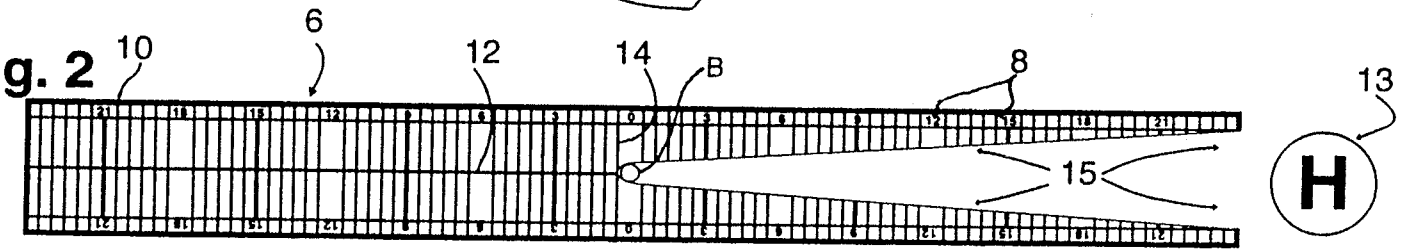
FIG. 2 is a general overall view of a first embodiment of the invention.

Referring to FIG. 2, there is illustrated a first embodiment of the invention, including the following elements: Mat 6, having indicator numbers 8, presenting the inches markings, borders along the outside of the mat, a center longitudinal path line 12 running the length of the mat to the golf ball labeled "B", lateral golf club face alignment lines 14 showing smaller divisions of inches without numbers, golf hole 13, and a V shaped notch 15.

Ideally, the longitudinal line 4 extends along a center axis of the mat, since it is thought that the ideal golf stroke results in the club face progressing along a straight line, with a minimum of curvature or deviation from a line corresponding from the longitudinal path line.

The V shaped notch 15 extends forward of the location of the golf ball B and permits the mat 6 to extend forward of the ball and yet will not interfere with the ball roll on putts. The V shaped notch 15 further allows for putts to be off center and yet provide feedback to the golfer.

It is understood that the divisions of inches may also be in other linear measurement, and that the distances between subsequent face alignment lines 14 need not be uniform. The uniform placement of the lateral lines is selected for ease of use as the golfer is viewing the mat 6 during the golf stroke.

Figure 3:
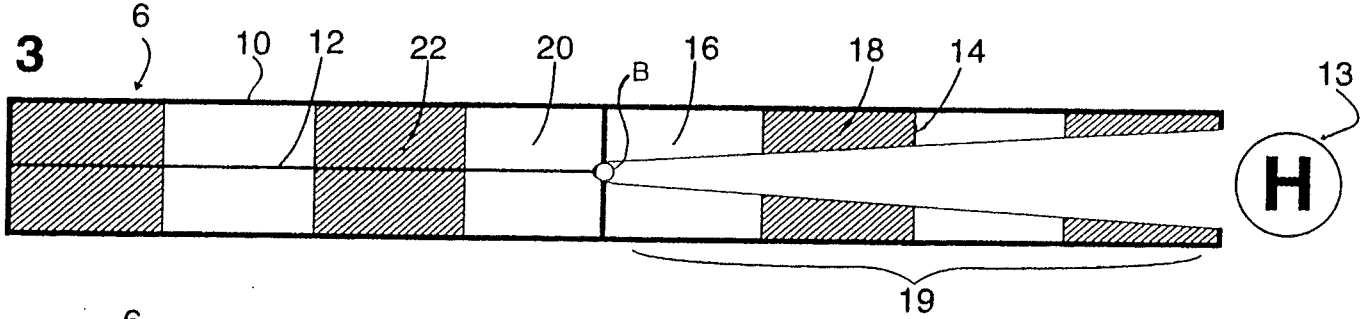
FIG. 3 is a general overall view of a second embodiment of the invention.

Referring to FIG. 3, there is a second embodiment of the invention illustrating color zones. There are first matching color zones 16 and 20, second matching color zones 18 and 22. It is also noted that the invention is designed so that the golf hole H can fit within and between the arms 19 of the mat and still have the ball a good distance from the hole.

Figure 4:
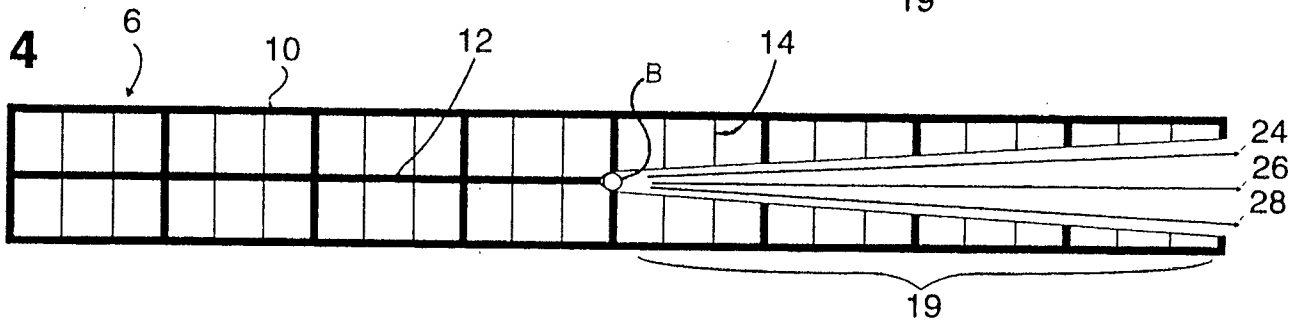
FIG. 4 is a general overall view of a third embodiment of the invention.

Referring to FIG. 4, there is a third embodiment of the invention illustrating the use of wide and thin lateral lines. Additionally, there is demonstrated that the ball may be mistakenly hit in various directions 24, 26, and 28, without interference from mat 6.

It is noted that with the long arms 19 of the mat, being anywhere in a range of 10 to 60 inches or more, that the arms provide both visual feedback to the golfer for the follow through stroke and the trajectory of the ball after being struck.

It is possible, by placing the hole between the arms (e.g., near the end of the arms), to provide even greater visual feedback to the golfer on shorter putting practicing. It is noted, that a high percentage of putting is usually within a 3 foot range. By having the arms extend to the hole and having a distance away from the hole a golfer can practice with guiding arms 19 indicating the rolling line of the ball as it moves to the hole.

It is further noted that the mat can be made of any type of thin material. The object is not to interfere with the golfers stroke.

Note that center line 12 is oriented along the desired ball path and the golf club stroke. Additionally, line 4 on the club will also be aligned with line 12 during practice. Likewise, lateral lines 14 will be aligned to line 3 on the club during practice. The matching of the club and mat lines provides visual feedback to the golfer in both the back and forward strokes.

Variations in the Invention

There are several obvious variations to the broad invention and thus come within the scope of the present invention. Uniquely, this invention may work with any golf club or golf stroke, and not just putting. The learning of a pendulum motion along the complete golfing stroke is assisted by the length of the mat in both the area behind the ball as well as beyond the ball where the crucial follow through stroke takes place.

It is also noted that any variation of the three illustrated embodiments is perfectly feasible. In other words, the use of color zones 16, 18, 23, and 22, along with inch numbering and wide and thin lines are all possible elements of any modification.

One skilled in the art would easily conceive of having several longitudinal lines 12 located at various positions along the mat to aid in golf practicing.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

Although subheadings in the Detailed Description of the Illustrated Embodiment are used, these are merely provided for assisting the reader; wherein, the writer is free to enter any information under any heading/s.

What is claimed and desired to be secured by United States Patent is:

1. A golfing aid, comprising:

a) a rectangular mat (6) having a V shaped notch (15) with its apex between two ends of the mat and its open portion extending between two arms ending at one end of the mat, the mat extending sufficiently to provide visual feedback to a golfer for a backstroke, a follow through stroke and a trajectory of the ball after being struck without interfering with the golfer's stroke, and without interfering with the ball roll, thereby allowing putts to be off-center and yet provide feedback to the golfer;

b) at least one longitudinal horizontal line (12) extending down the length of an extension of the mat portion not having the arms, said line oriented along a desired golf club path and terminating at said apex; and c) a plurality of lateral lines (14) being perpendicular to the longitudinal line, and located along the entire length of the mat, thereby providing said visual feedback to the golfer.

2. The golf aid of claim 1, further comprising:

said two arms (19) extending from said apex, the arms being wide enough apart to place a golf ball hole (13) between the arms, and the two arms extending from said apex a distance of 12 to 60 inches.

3. The golf aid of claim 2, further comprising:

a) a golf club having a golf club head with matching lateral and longitudinal lines thereon; and b) the lateral lines and longitudinal lines on the mat corresponding to said lateral and longitudinal lines on the golf club head.

4. The golf aid of claim 3, further comprising:

some of the lateral lines numbered indicative of the linear measurement away from the apex of the notch.

5. The golf aid of claim 2, further comprising:

a) said longitudinal horizontal center line (12) extending down the length of one half of the mat portion not having the arms representing an idealized stroke path;

b) said plurality of lateral lines (14) representing an idealized club face alignment;

c) a golf club having a golf club head with matching lateral and longitudinal lines thereon; and
d) the lateral lines and longitudinal lines on the mat corresponding to said lateral and longitudinal lines on the golf club head.

6. The golf aid of claim 5, further comprising:
some of the lateral lines being numbered indicative of the linear measurement away from the apex of the notch of the back and follow through strokes.

7. The golf aid of claim 2, further comprising:
a) the lateral lines forming a first plurality of zones of color (20, 22) located along the longitudinal line, and a second plurality of zones of color (16, 18) mirroring the color pattern of the first zones and located along the arms of the mat; and
b) a golf club having a golf club head with corresponding lateral and longitudinal lines thereon; and
c) the lateral lines and longitudinal lines on the mat corresponding to said lateral and longitudinal lines on the golf club head.

8. The golf aid of claim 2, further comprising:
a) the lateral lines comprising a first set of lines being wider than a second set of lines, both set of lines located symmetrically from the apex of the notch and extending down the arms of the mat and the portion of the mat not having the notch; and
b) a golf club having a golf club head with matching lateral and longitudinal lines thereon; and
c) the lateral lines and longitudinal lines on the mat corresponding to said lateral and longitudinal lines on the golf club head.

9. The golf aid of claim 2, further comprising:
a) a gold club having a golf club head with a matching longitudinal line thereon; and
b) the longitudinal line on the mat corresponding to said longitudinal line on the golf club head.

10. The golf aid of claim 9, further comprising:
some of the lateral lines numbered indicative of the linear measurement away from the apex of the notch.

11. The golf aid of claim 2, further comprising:
a) said longitudinal horizontal center line (12) extending down the length of one half of the mat portion not having the arms representing an idealized stroke path;
b) said plurality of lateral lines (14) representing an idealized club face alignment;
c) a golf club having a golf club head with a matching longitudinal line thereon; and
d) the longitudinal line on the mat corresponding to said longitudinal line on the golf club head.

12. The golf aid of claim 11, further comprising:
some of the lateral lines being numbered indicative of the linear measurement away from the apex of the notch of the back and follow through strokes.

13. The golf aid of claim 2, further comprising:
a) the lateral lines forming a first plurality of zones of color (20, 22) located along the longitudinal line, and a second plurality of zones of color (16, 18) mirroring the color pattern of the first zones and located along the arms of the mat; and
b) a golf club having a golf club head with a corresponding longitudinal line thereon; and
c) the longitudinal lines on the mat corresponding to said longitudinal line on the golf club head.

14. The golf aid of claim 2, further comprising:
a) the lateral lines comprising a first set of lines being wider than a second set of lines, both set of lines located symmetrically from the apex of the notch and extending down the arms of the mat and the portion of the mat not having the notch; and
b) a golf club having a golf club head with a matching longitudinal line thereon; and
c) the longitudinal line on the mat corresponding to said longitudinal line on the golf club head.

15. A golfing aid, comprising:
a) a rectangular mat (6) having a V shaped notch (15) with its apex between two ends of the mat and its open portion ending at one end of the mat, the mat extending sufficiently to provide visual feedback to a golfer for a backstroke, for a follow through stroke and a trajectory of the ball after being struck without interfering with the golfer's stroke, and without interfering with the ball roll;
b) two arms (19) extending from said apex, the arms being wide enough apart to place a golf ball hole (13) between the arms;
c) the two arms extending from said apex a distance of at least several golf club head lengths;
d) at least one longitudinal horizontal line (12) extending down the length of one half of the mat portion not having the arms;
e) a plurality of lateral lines (14) being perpendicular to the longitudinal line, and located along the entire length of the mat, thereby providing said visual feedback to the golfer;
f) some of the lateral lines are numbered indicative of the inches away from the apex of the notch;
g) a golf club having a golf club head with matching lateral and longitudinal lines thereon; and
h) the lateral lines and longitudinal lines on the mat corresponding to said lateral and longitudinal lines on the golf club head.

16. A golfing aid, comprising:
a) a rectangular mat (6) having a V shaped notch (15) with its apex between two ends of the mat and its open portion ending at one end of the mat, the mat extending sufficiently to provide visual feedback to a golfer for a backstroke, for a follow through stroke and a trajectory of the ball after being struck without interfering with the golfer's stroke, and without interfering with the ball roll;
b) two arms (19) extending from said apex, the arms being wide enough apart to place a golf ball hole (13) between the arms;
c) the two arms extending from said apex a distance of 12 to 60 inches;
d) at least one longitudinal horizontal line (12) extending down the length of one half of the mat portion not having the arms;
e) a plurality of lateral lines (14) being perpendicular to the longitudinal line, and located along the entire length of the mat, thereby providing said visual feedback to the golfer;
f) the lateral lines forming a first plurality of zones of color (20, 22) located along the longitudinal line, and a second plurality of zones of color (16, 18) mirroring the color pattern of the first zones and located along the arms of the mat;
g) a golf club having a golf club head with a corresponding longitudinal line thereon; and
h) the longitudinal line on the mat corresponding to said longitudinal line on the golf club head.
some of the lateral lines numbered indicative of the linear measurement away from the apex of the notch.

* * * * *